US007322480B2

(12) United States Patent
Bragadeste et al.

(10) Patent No.: US 7,322,480 B2
(45) Date of Patent: Jan. 29, 2008

(54) METHOD AND APPARATUS FOR PALLETIZING A PRODUCT

(75) Inventors: Rui Bragadeste, Round Rock, TX (US); James Edwin Manuel, Austin, TX (US); Tyler Buttrill, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 399 days.

(21) Appl. No.: 10/964,401

(22) Filed: Oct. 13, 2004

(65) Prior Publication Data

US 2006/0076255 A1 Apr. 13, 2006

(51) Int. Cl.
*B65D 19/04* (2006.01)

(52) U.S. Cl. ..... 206/599; 206/600; 108/51.3; 53/458

(58) Field of Classification Search ..... 206/386, 206/596, 599, 600; 108/51.11, 51.3, 55.1, 108/56.1, 57.29, 115; 53/452, 456–458, 53/467

See application file for complete search history.

(56) References Cited

U.S. PATENT DOCUMENTS

| | | | | |
|---|---|---|---|---|
| 3,519,190 | A * | 7/1970 | Achermann et al. | 206/599 |
| 4,119,205 | A * | 10/1978 | Delany | 206/598 |
| 4,863,024 | A * | 9/1989 | Booth | 206/386 |
| 5,269,219 | A | 12/1993 | Juvik-Woods | |
| 5,531,166 | A | 7/1996 | Woods et al. | |
| 5,537,937 | A * | 7/1996 | Juvik-Woods | 108/51.3 |
| 5,595,304 | A * | 1/1997 | Timmins | 206/600 |
| 5,809,903 | A * | 9/1998 | Young, Jr. | 108/51.3 |
| 5,816,173 | A * | 10/1998 | Warneford | 108/51.11 |
| 5,918,744 | A * | 7/1999 | Bringard et al. | 206/596 |
| 6,283,044 | B1 | 9/2001 | Apps | |
| 6,357,364 | B1 | 3/2002 | Maloney et al. | |
| 6,557,708 | B2 | 5/2003 | Polacco | |
| 6,705,515 | B2 | 3/2004 | Dowd | |

* cited by examiner

*Primary Examiner*—Luan K Bui
(74) *Attorney, Agent, or Firm*—Haynes and Boone, LLP

(57) ABSTRACT

A corrugate palletized container is provided that includes a base defining at least one channel, the channel operable to accept a lifting device therein and a plurality of side walls extending from the base, the plurality of side walls defining a storage space between them.

8 Claims, 12 Drawing Sheets

100
702
104a
104b
104c
104d
104aa
102a
102b
102ae
102ad
102ab
102bb
102af
102aa
700a
102bd
102ba
102ac
700b
102bc

METHOD AND APPARATUS FOR PALLETIZING A PRODUCT

BACKGROUND

The present disclosure relates generally to shipping containers, and more particularly to a method and apparatus for palletizing a product to be shipped.

Products that weigh over a certain amount raise a number of issues with regards to transporting those products. A high weight product typically requires that the product be attached to a pallet in order to allow for mechanical lifting of the product by a machine such as, for example, a forklift. Generally, a box is attached to a pallet by straps and/or fasteners, and the product is placed in the box when it is ready to be shipped. The pallets are generally made of wood to reduce cost and allow easy attachment of the box to the pallet.

However, freight costs for shipping the product are determined based on the weight of the combined product, box, and pallet. Wooden pallets and the components necessary to attach the box to the pallet increase the weight of the combination, increasing the cost of shipping the product.

Furthermore, the box and pallet must be lifted by factory operators in order to position the box on a conveyor or some other means which will position the box appropriately such that the product may be placed in it. The additional weight of the wooden pallet and components necessary to attach the box to the pallet may be lifted several hundreds of times per day, creating ergonomic issues with the factory operators.

Finally, in order to ship products overseas, wooden pallets must be treated to ensure they do not carry bugs. Products attached to wooden pallets may be held up during overseas transportation or rejected all together due to possible bug issues with the wooden pallets.

Accordingly, it would be desirable to provide an improved method and apparatus for palletizing a product absent the disadvantages found in the prior methods discussed above.

SUMMARY

According to one embodiment, a corrugate palletized container is provided that includes a base defining at least one channel, the channel operable to accept a lifting device therein, and a plurality of side walls extending from the base, the plurality of side walls defining a storage space between them.

A principal advantage of this embodiment is that a product may be shipped in the corrugate palletized container with a weight reduction from standard shipping methods that reduces shipping costs and ergonomic issues with respect to lifting the container. Furthermore, the corrugate material reduces issues related to bugs that can complicate overseas shipping.

DETAILED DESCRIPTION

Figure 1:
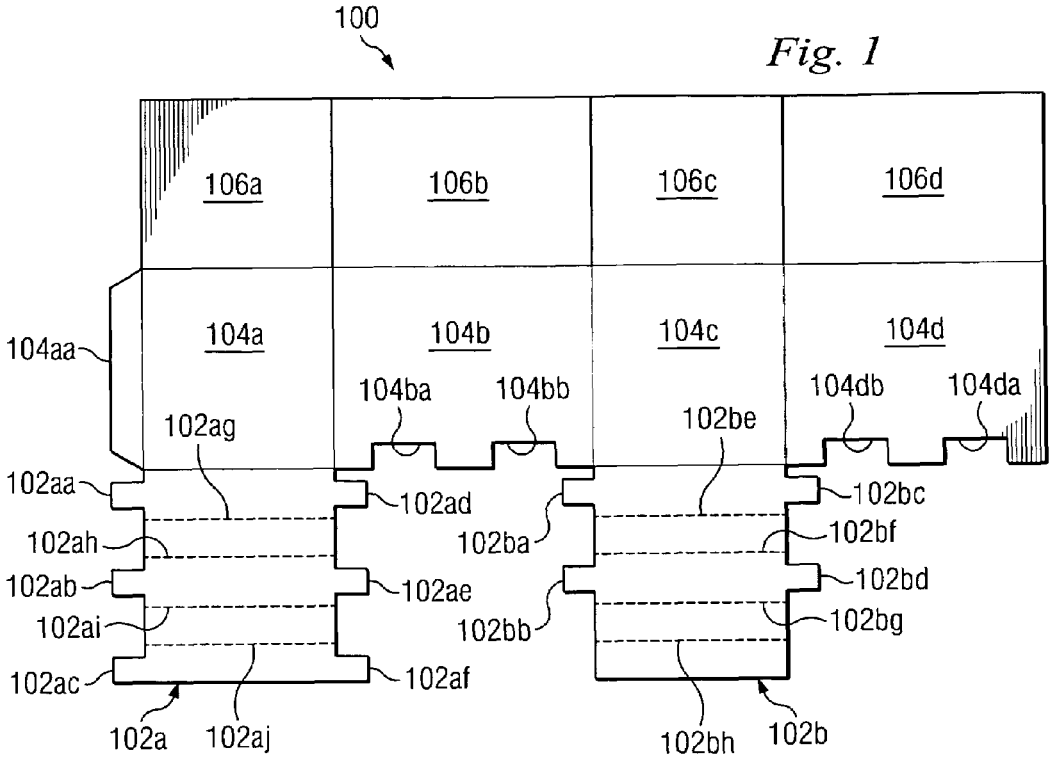
FIG. 1 is a side view illustrating an exemplary embodiment of an unassembled pallet container.

In an exemplary embodiment, as illustrated in FIG. 1, a pallet container 100 includes a single piece of material including a plurality of base portions 102*a* and 102*b*. Base portion 102*a* includes a plurality of tabs 102*aa*, 102*ab*, 102*ac*, 102*ad*, 102*ae*, and 102*af* extending from the base portion 102*a* in a spaced apart relationship on opposite sides of the base portion 102*a*. Base portion 102*a* may be perforated along lines 102*ag* and 102*ah* which are positioned between tabs 102*aa*, 102*ab*, 102*ad*, and 102*ae* and run parallel to each other. Base portion 102*a* may also be perforated along lines 102*ai* and 102*aj* which are positioned between tabs 102*ab*, 102*ac*, 102*ae*, and 102*af* and run parallel to each other. Base portion 102*b* includes a plurality of tabs 102*ba*, 120*bb*, 102*bc*, and 102*bd* extending from the base portion 102*b* in a spaced apart relationship on opposite sides of the base portion 102*b*. Base portion 102*b* may be perforated along lines 102*be* and 102*bf* which are positioned between tabs 102*ba*, 102*bb*, 102*bc*, and 102*bd* and run parallel to each other. Base portion 102*b* may also be perforated along lines 102*bg* and 102*bh* which are positioned adjacent tabs 102*bb* and 102*bd* and run parallel to each other.

A plurality of side walls 104*a*, 104*b*, 104*c*, and 104*d* extend from the base portions 102*a* and 102*b* due to the extension of side wall 104*a* from base portion 102*a* and the extension of side wall 104*c* from base portion 102*b*. Side wall 104*b* extends between side walls 104*a* and 104*c*, and side wall 104*d* extends from side wall 104*c*. Side wall 104*a* is bendably coupled to the base portion 102*a* and includes a tab 104*aa* extending from it. Side wall 104*b* is bendably coupled to side wall 104*a* and side wall 104*c* and defines a plurality of channel inlet/outlets 104*ba* and 104*bb* on its edge. Side wall 104*c* is bendably coupled to side wall 104*b*, base portion 102*b*, and side wall 104*d*. Side wall 104*d* is bendably coupled to side wall 104*c* and defines a plurality of channel inlet/outlets 104*da* and 104*db* on its edge.

A plurality of top portions 106*a*, 106*b*, 106*c*, and 106*d* extend from side walls 104*a*, 104*b*, 104*c*, and 104*d*, respectively. Top portion 106*a* is bendably coupled to side wall 104*a*. Top portion 106*b* is bendably coupled to side wall 104*b*. Top portion 106*c* is bendably coupled to side wall 104*c*. Top portion 106*d* is bendably coupled to side wall 104*d*.

In an exemplary embodiment, the pallet container 100 may be comprised of a variety of materials such as, for example, cardboards, corrugates, plastics, or other equivalent materials known in the art.

Figure 2:
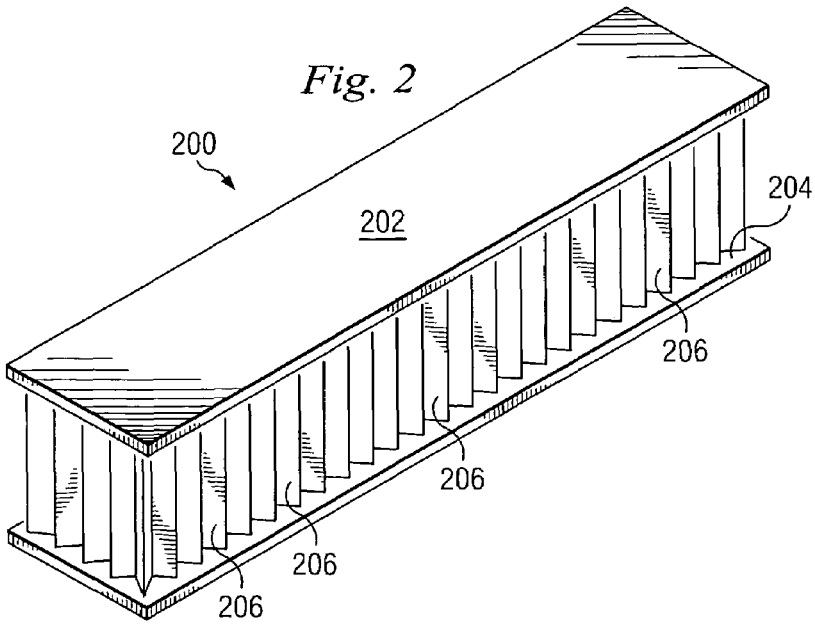
FIG. 2 is a perspective view illustrating an exemplary embodiment of a interior reinforcement member used with the pallet container of FIG. 1.

Referring now to FIG. 2, an interior reinforcement member 200 is illustrated and includes a top 202 and a bottom 204 which are spaced apart and coupled together by a plurality of vertical structural members 206. In an exemplary embodiment, the interior reinforcement member 200 may be comprised of a variety of materials such as, for example, cardboards, corrugates, plastics, or other equivalent materials known in the art. In an exemplary embodiment, the vertical structural members 206 may be made of the same material as the top 202 and bottom 204 and may be positioned such that they have a honeycomb cross-section.

Figure 3:
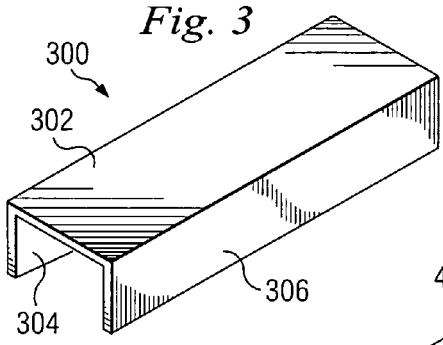
FIG. 3 is a perspective view illustrating an exemplary embodiment of an exterior reinforcement member used with the pallet container of FIG. 1.

Referring now to FIG. 3, an exterior reinforcement member 300 is illustrated and includes a base 302 and a plurality of arms 304 and 306 extending from opposite edges of the base 302 and along its length such that the member 300 has a substantially U-shaped cross section. In an exemplary embodiment, the exterior reinforcement member 300 may be comprised of a variety of materials such as, for example, cardboards, corrugates, plastics, or other equivalent materials known in the art.

Figure 4:
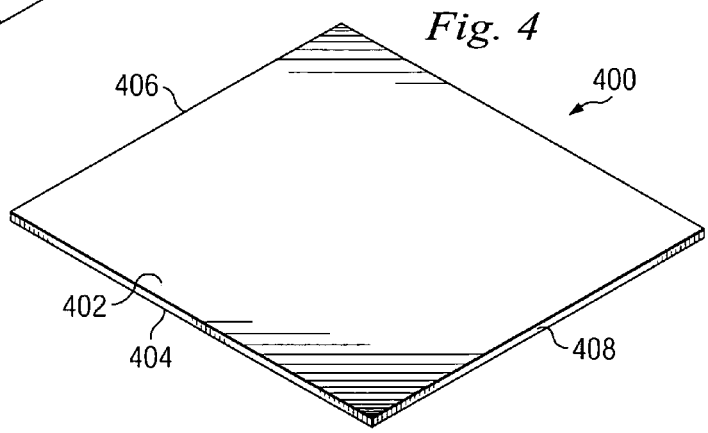
FIG. 4 is a perspective view illustrating an exemplary embodiment of a support panel used with the pallet container of FIG. 1.

Referring now to FIG. 4, a support panel 400 is illustrated and includes a substantially square piece of material with a top surface 402, a bottom surface 404 opposite the top surface 402, and a plurality of opposing sides 406 and 408. In an exemplary embodiment, the support panel 400 may be comprised of a variety of materials such as, for example, cardboards, corrugates, plastics, or other equivalent materials known in the art.

Figure 5:
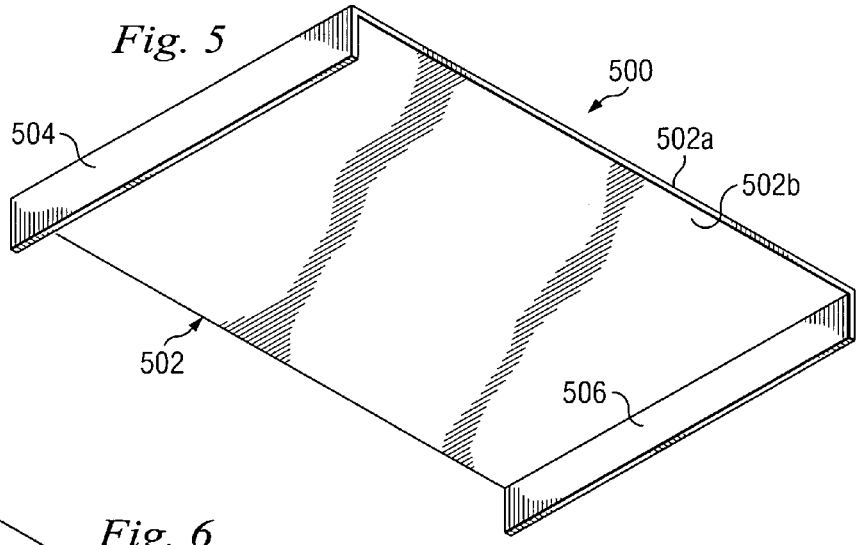
FIG. 5 is a perspective view illustrating an exemplary embodiment of a cover panel used with the pallet container of FIG. 1.

Referring now to FIG. 5, a cover panel 500 is illustrated and includes a base 502 including a top surface 502*a* and a bottom surface 502b opposite the top surface 502*a*. A plurality of arms 504 and 506 extend from opposite edges of the base 502 and along its length. In an exemplary embodiment, the cover panel 500 may be comprised of a variety of materials such as, for example, cardboards, corrugates, plastics, or other equivalent materials known in the art.

Figure 6:
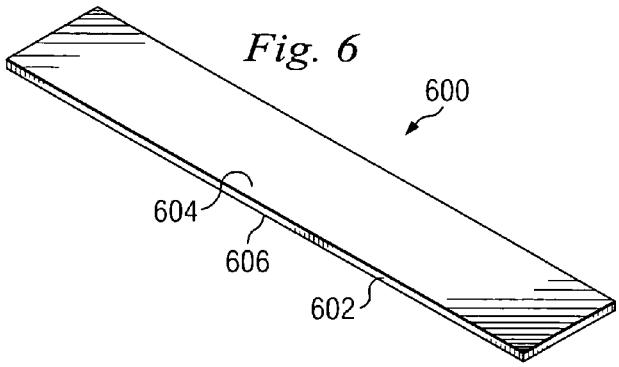
FIG. 6 is a perspective view illustrating an exemplary embodiment of a base support used with the pallet container of FIG. 1.

Referring now to FIG. 6, a base support 600 includes an elongated member 602 having a top surface 604 and a bottom surface 606 opposite the top surface 604. In an exemplary embodiment, the base support 600 may be comprised of a variety of materials such as, for example, cardboards, corrugates, plastics, or other equivalent materials known in the art.

Figure 7A:
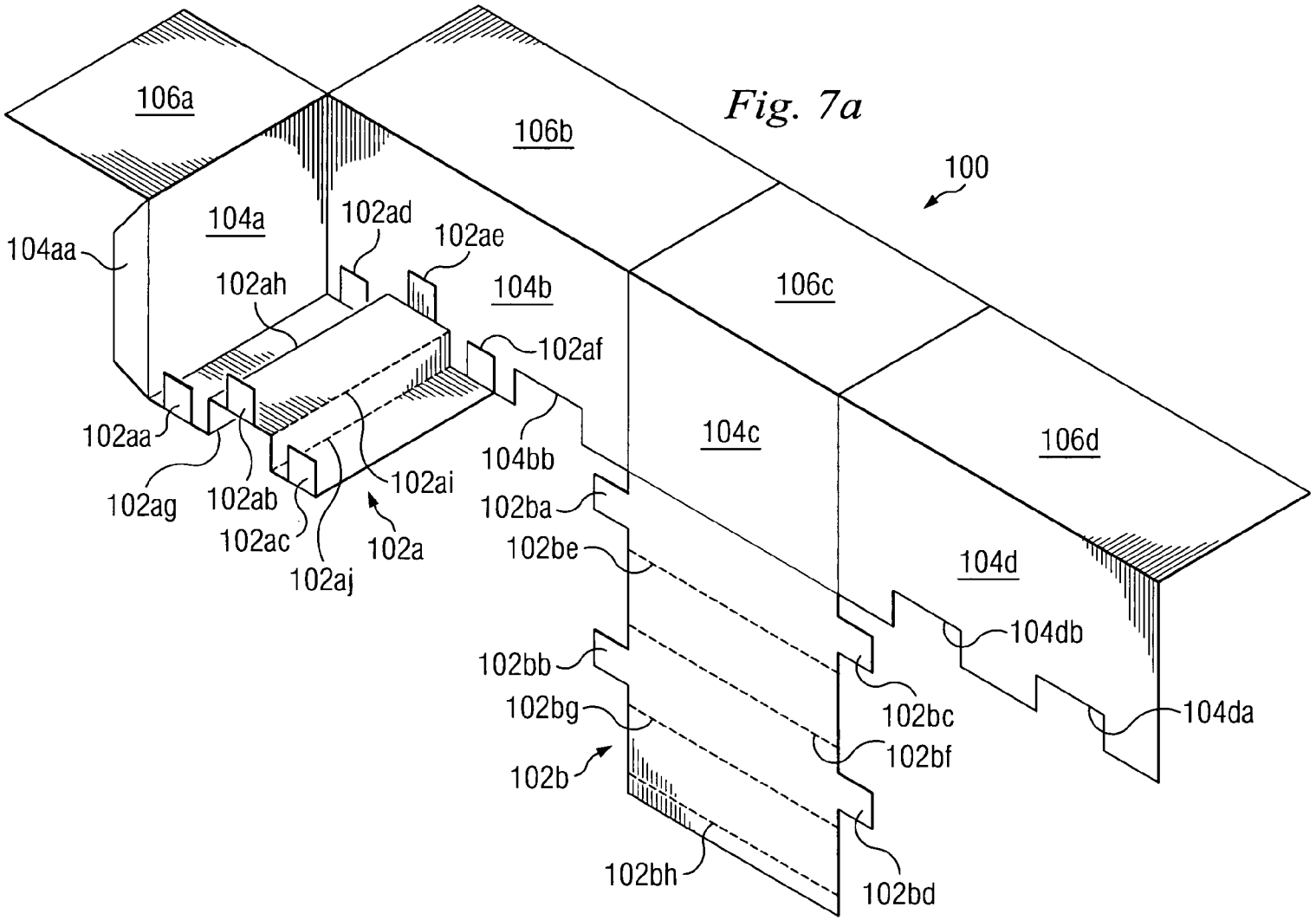
FIG. 7*a* is a perspective view illustrating an exemplary embodiment of the pallet container of FIG. 1 partially assembled.
Figure 7B:
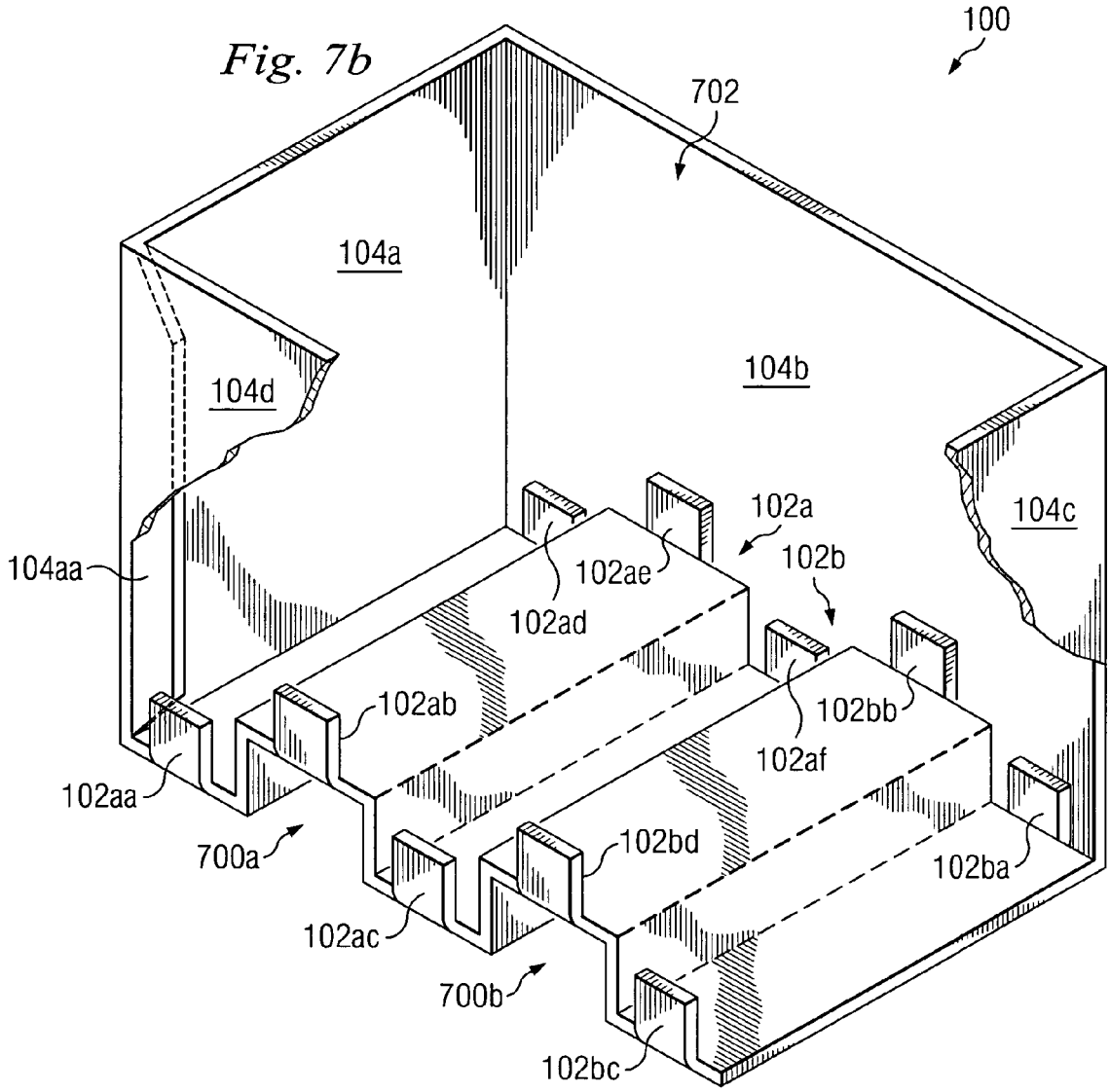
FIG. 7*b* is a cut-away perspective view illustrating an exemplary embodiment of the pallet container of FIG. 1 assembled.

Referring now to FIGS. 1, 6, 7*a* and 7*b*, in assembly operation, pallet container 100 begins assembly by bending base portion 102*a* with respect to side wall 104*a* until the two are at approximately a ninety degree angle, as illustrated in FIG. 7*a*. Side wall 104*a* may then be bent at approximately a ninety degree angle with respect to side wall 104*b*. Base portion 102*a* may then be bent at approximately ninety degree angles along perforated lines 102*ag*, 102*ah*, 102*ai*, and 102*aj* such that the edge of base portion 102*a* including tabs 102*ad*, 102*ae*, and 102*af* to run substantially along the edges of channel inlet/outlet 104*ba* on side wall 104*b*. Tabs 102*ad*, 102*ae* and 102*af* may then be bent at approximately ninety degree angles with respect to base portion 102*a* such that they may be secured to side wall 104*b* by glue, staples, or other conventional securing means known in the art.

Base portion 102*b* is bent with respect to side wall 104*c* until the two are at approximately a ninety degree angle. Side wall 104*c* may then be bent at approximately a ninety degree with respect to side wall 104*b*. Base portion 102*b* may then be bent at approximately ninety degree angles along perforated lines 102*be*, 102*bf*, 102*bg*, and 102*bh* such that the edge of base portion 102*b* including tabs 102*ba* and 102*bb* to run substantially along the edges of channel inlet/outlet 104*bb* on side wall 104*b*. Tabs 102*ba* and 102*bb* may then be bent at approximately ninety degree angles with respect to base portion 102*b* such that they may be secured to side wall 104*b* by glue, staples, or other conventional securing means known in the art.

Base portion 104*d* is bent with respect to side wall 104*c* until the two are at approximately a ninety degree angle, such that the edge of base portion 102*b* including tabs 102*bc* and 102*bd* running along the edge of channel outlet 104*da*, and the edge of base portion 102*a* including tabs 102*aa*, 102*ab* and 102*ac* runs along the edge of channel inlet/outlet 104*db*. Tabs 102*aa*, 102*ab*, and 102*ac* may then be bent at approximately ninety degree angles with respect to base portion 102*a*, and tabs 102*bd* and 102*bc* may then be bent at approximately ninety degree angles with respect to base portion 102*b*, such that the tabs 102*aa*, 102*ab*, 102*ac*, 102*bd* and 102*bc* may be secured to side wall 104*d* by glue, staples, or other conventional securing means known in the art. Tab 104*aa* is bent at approximately a ninety degree angle with respect to side wall 104*a* such that it may be secured to side wall 104*d* by glue, staples, or other convention securing means known in the art. Pallet container 100 now defines a plurality of channels 700*a* and 700*b*, with channel 700*a* running along a width of pallet container 100 and including channel inlet/outlets 104*ba* and 104*da*, and with channel 700*b* running parallel to channel 700*a* and along a length of pallet container 100 and including channel inlet/outlets 104*bb* and 104*db*. Side walls 104*a*, 104*b*, 104*c*, and 104*d* now define a storage space 702 positioned between them. In several exemplary embodiments, the pallet container 100 may be assembled using a variety of equivalent alternative means known in the art and therefore may not includes features such as, for example, tabs 102*aa*, 102*ab*, 102*ac*, 102*ad*, 102*ae*, 102*af*, 102*ba*, 102*bb*, 102*bc*, and 102*bd*.

Figure 8:
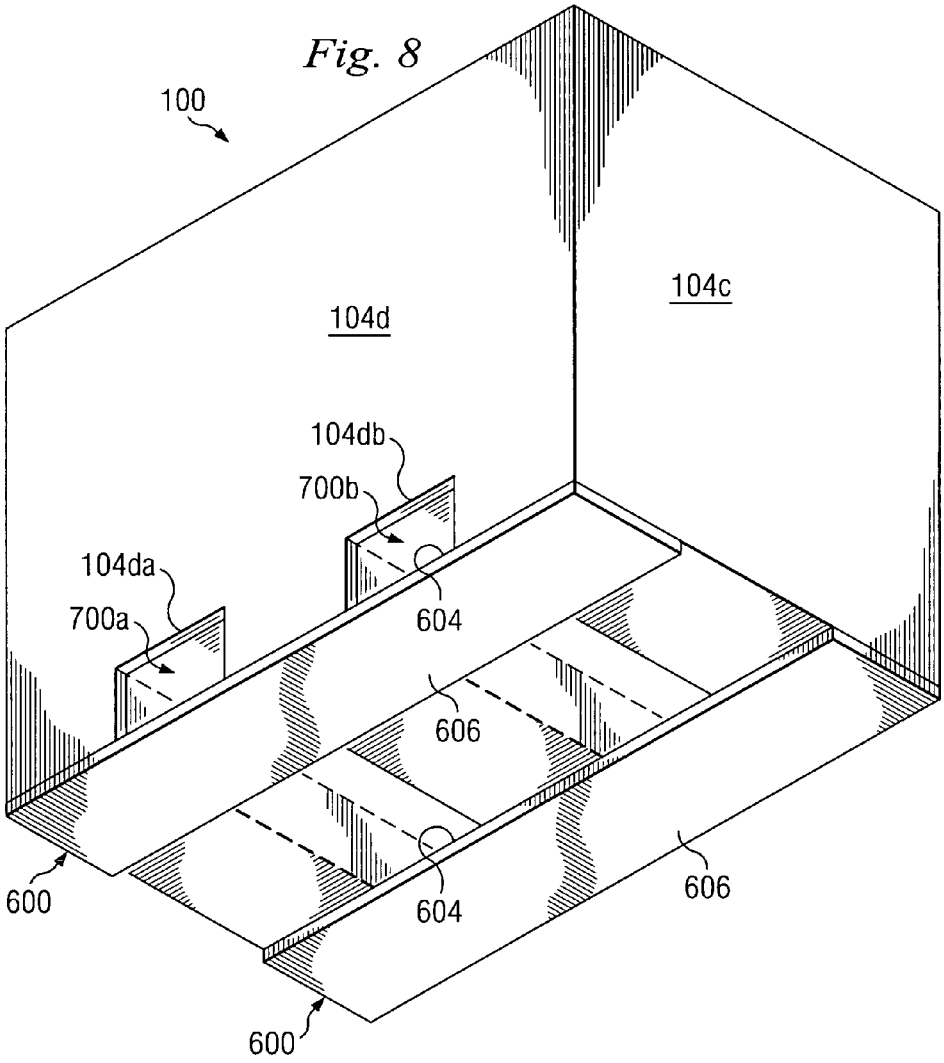
FIG. 8 is a perspective view illustrating an exemplary embodiment of the pallet container of FIG. 7*b* including a plurality of the base supports of FIG. 6.
Figure 9A:
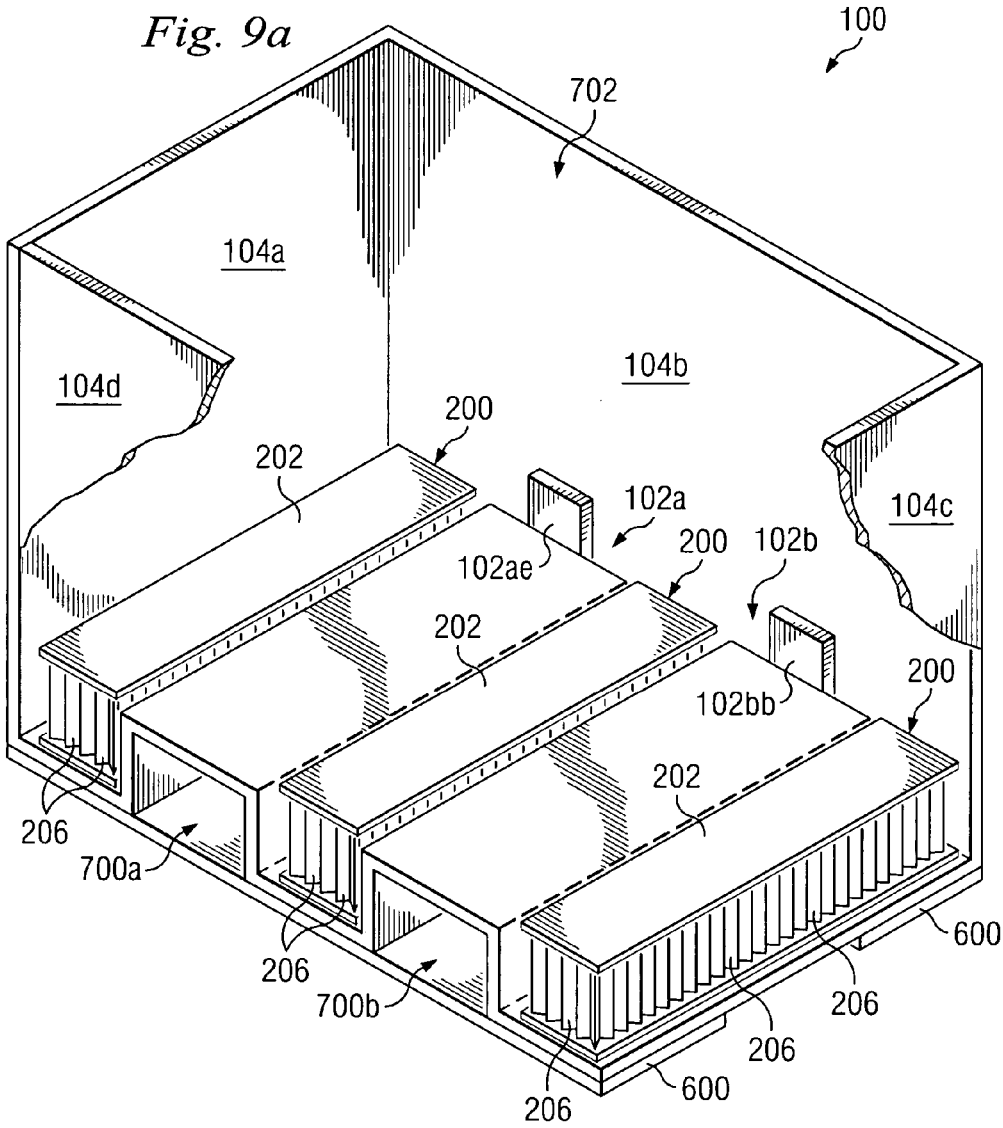
FIG. 9*a* is a cut-away perspective view illustrating an exemplary embodiment of the pallet container of FIG. 8 including a plurality of the interior reinforcement members of FIG. 2.
Figure 9B:
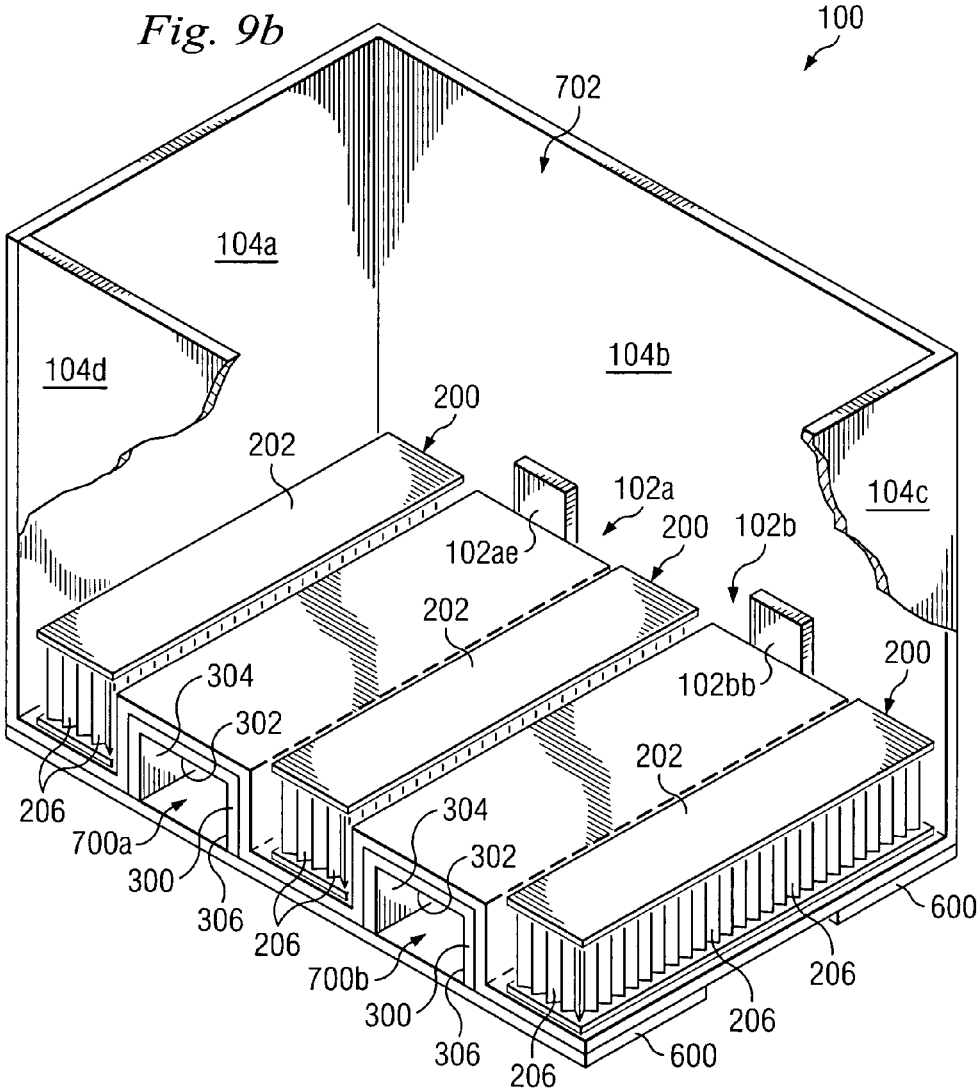
FIG. 9*b* is a cut-away perspective view illustrating an exemplary embodiment of the pallet container of FIG. 9*a* including a plurality of the exterior reinforcement members of FIG. 3.

Referring now to FIG. 8, the top surface 604 of a base support 600 is secured to the pallet container 100 adjacent the channel inlet/outlets 104*da* and 104*db* and substantially perpendicular to the channels 700*a* and 700*b*. The base support 600 may be secured to the pallet container 100 by glue, staples, or other convention securing means known in the art. The top surface 604 of a base support 600 is also secured to the pallet container 100 adjacent the channel inlet/outlets 104*ba* and 104*bb* (not shown), substantially perpendicular to the channels 700*a* and 700*b* and substantially parallel to the other base support 600. The base supports 600 may be secured to the pallet container 100 by glue, staples, or other convention securing means known in the art.

Referring now to FIG. 2, 3, 9*a* and 9*b*, a plurality of interior reinforcement members 200 are positioned in the storage space 702, extending along the length of channels 700*a* and 700*b* and on opposite sides of each channel 700*a* and 700*b*. In an exemplary embodiment, when positioned in the storage space 702, the top 202 of each interior reinforcement member 200 is substantially the same height at the channel 700*a* or 700*b*. A plurality of exterior reinforcement members 300 are positioned in the channels 700*a* and 700*b* and the bases 302 and arms 304 and 306 are secured to the walls of the channels 700*a* and 700*b* by glue, staples, or a variety of other conventional securing means known in the art.

Referring now to FIGS. 4, 9*a*, 9*b* and 10, support panel 400 is positioned in the storage space 702 such that bottom surface 404 of support panel 400 engages sections of base portions 102*a* and 102*b* that define channels 700*a* and 700*b* and the top 202 of the interior reinforcement member 200 positioned between channels 700*a* and 700*b*. In an exemplary embodiment, side 406 of support panel 400 is adjacent an edge of channel 700*a* and side 408 of support panel 400 is adjacent an edge of channel 700*b* when the support panel 400 is positioned in storage space 702.

Figure 10:
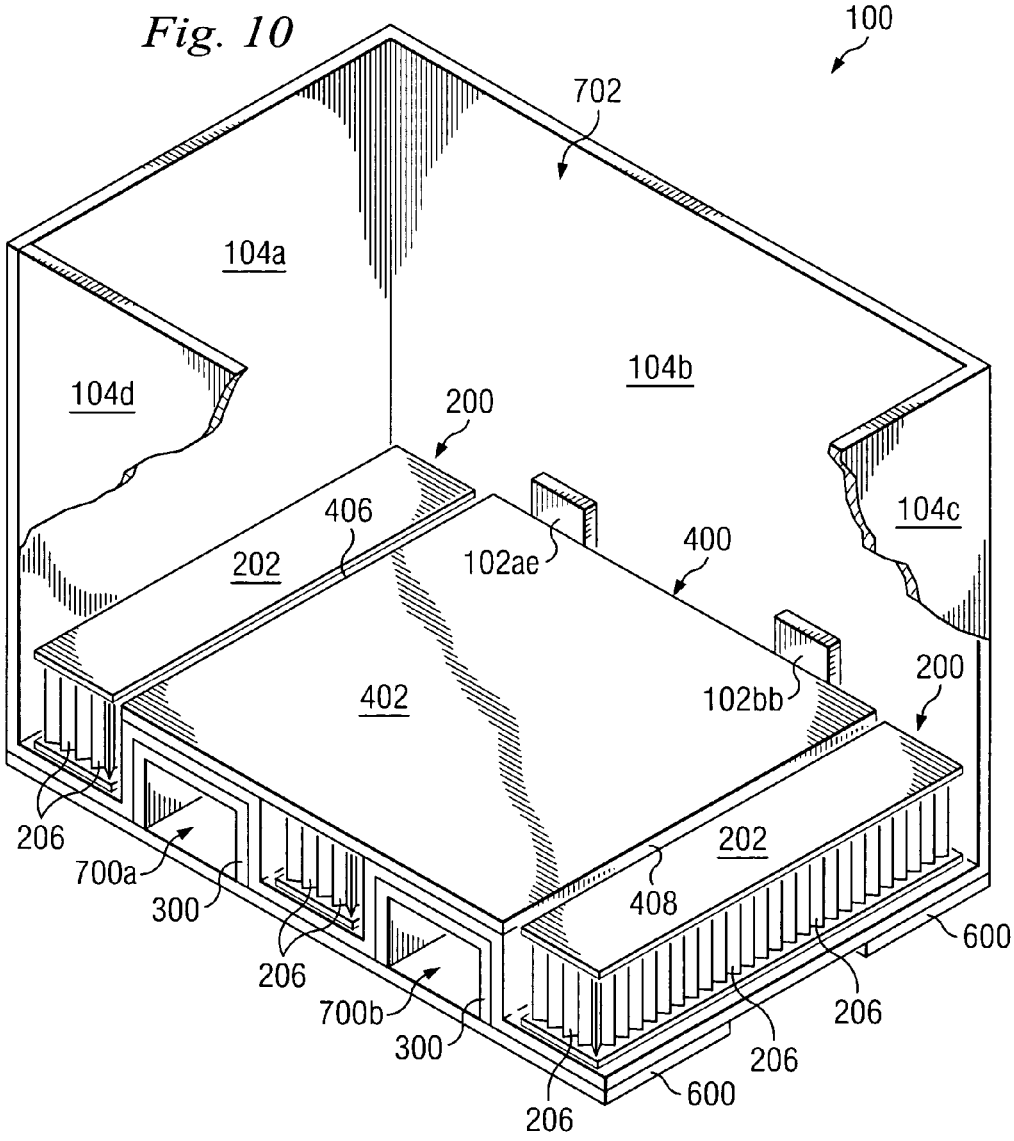
FIG. 10 is a cut-away perspective view illustrating an exemplary embodiment of the pallet container of FIG. 9*b* including the support panel of FIG. 4.
Figure 11:
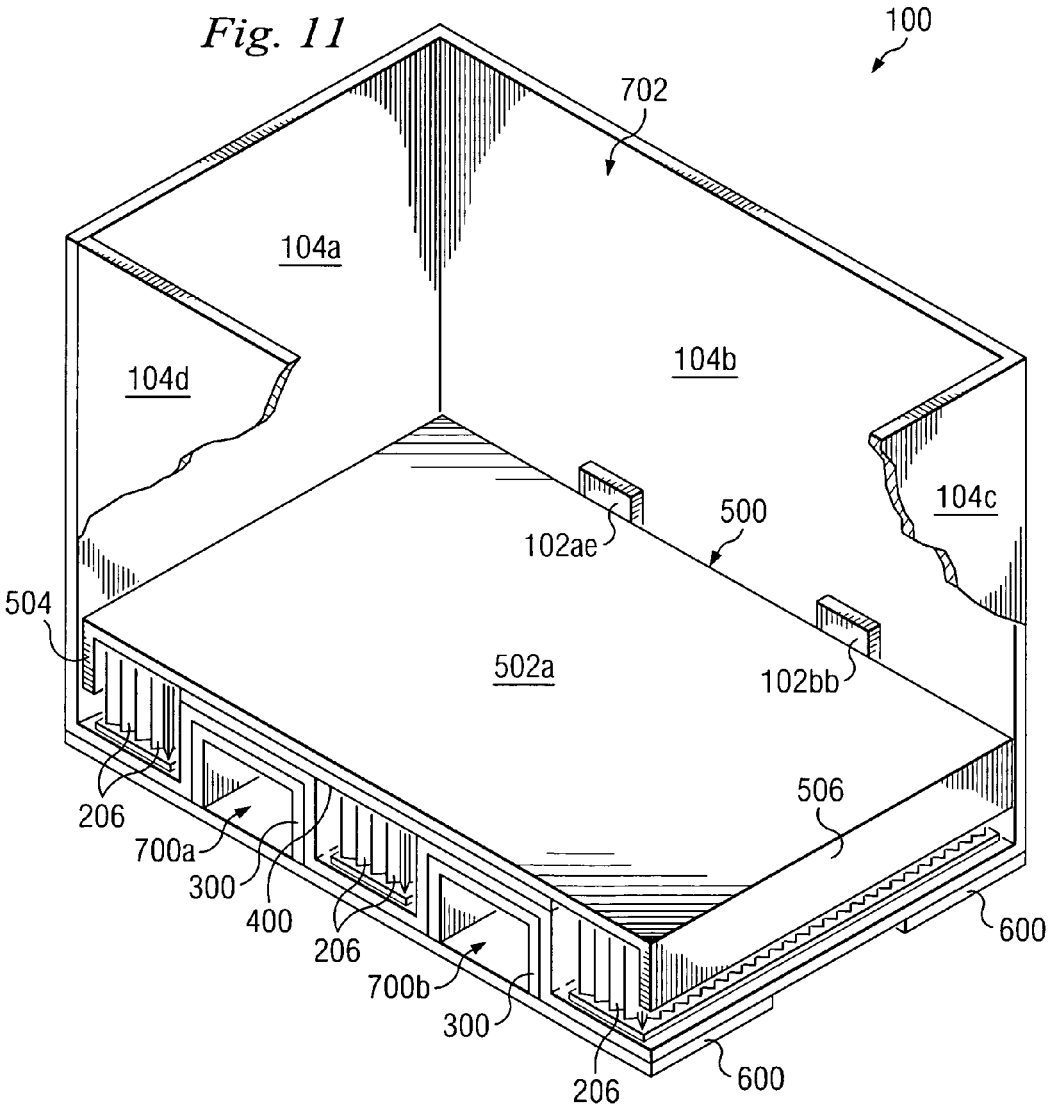
FIG. 11 is a cut-away perspective view illustrating an exemplary embodiment of the pallet container of FIG. 10 including the cover panel of FIG. 5.

Referring now to FIG. 5, 10 and 11, cover panel 500 is positioned in storage space 702 such that bottom surface 502*b* of base 502 engages top surface 402 of support panel 400 and the tops 202 of the interior reinforcement members 200 not engaged by support panel 400, and arms 504 and 506 engage side walls 104*a* and 104*c*.

Figure 12:
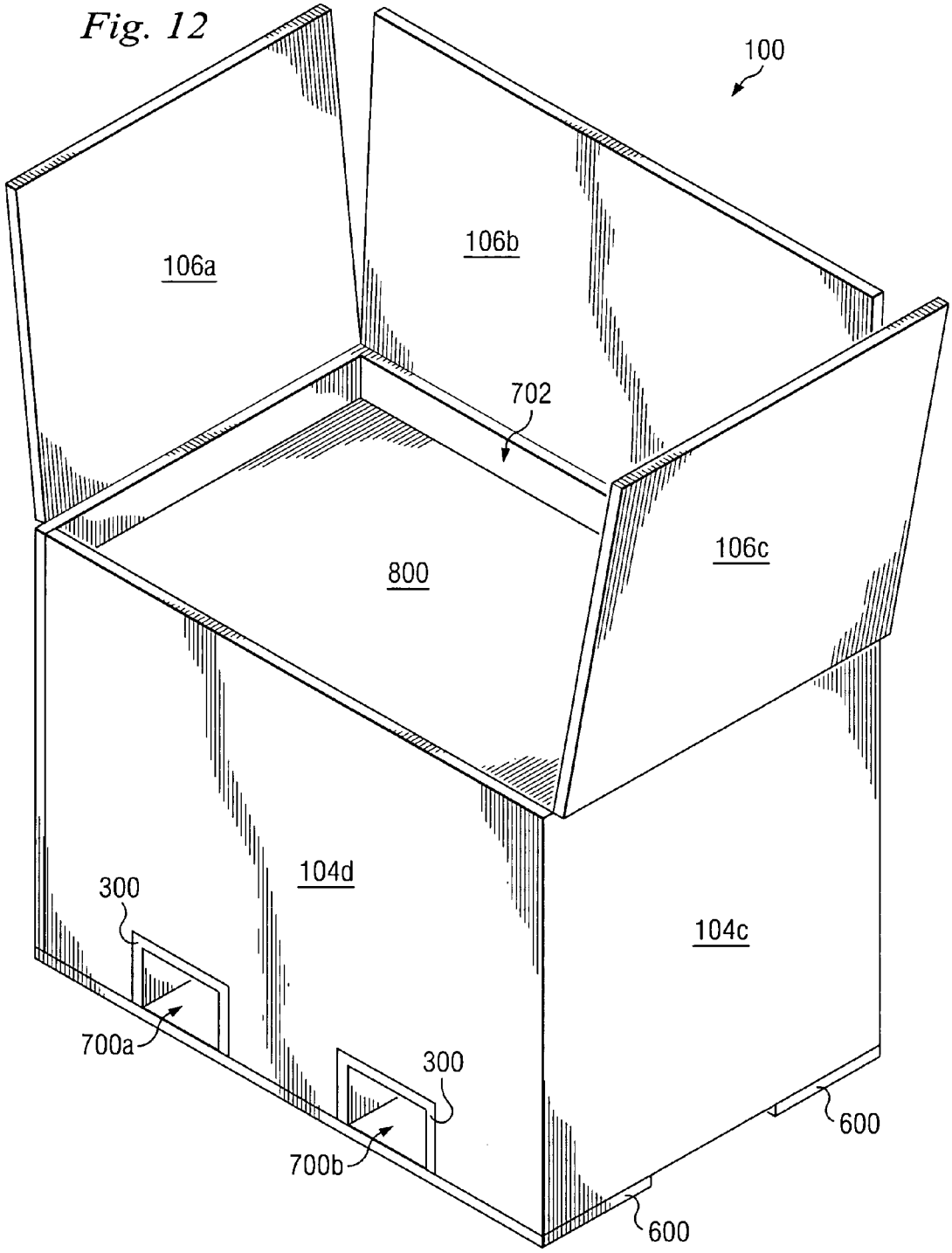
FIG. 12 is a perspective view illustrating an exemplary embodiment of the pallet container of FIG. 11 including a product in the storage space.

Referring now to FIG. 12, a product 800 may be positioned in the storage space 702 for shipping. In an exemplary embodiment, product 800 may be a server, an information handling system, or a variety of other products known in the art. Top portions 106*a*, 106*b*, 106*c*, and 106*d* (not shown) may then be closed, and the pallet container 100 may be lifted by placing a lifting device in the channels 700*a* and 700*b* and lifting the pallet container 100 and placing it in an appropriate vehicle for shipping.

Figure 13:
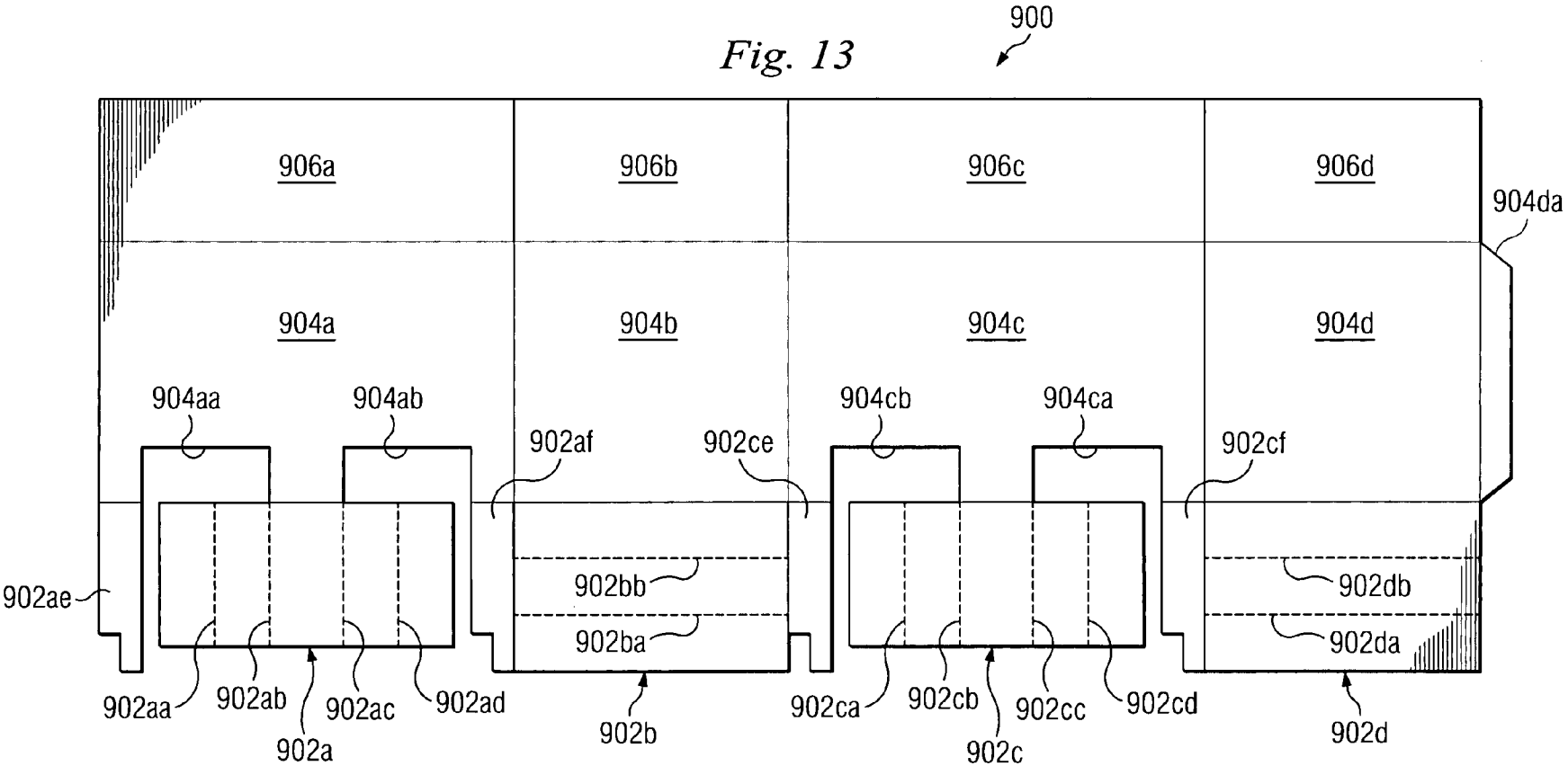
FIG. 13 is a front view illustrating an exemplary embodiment of a pallet container.

Referring now to FIG. 13, an alternative embodiment of a pallet container 900 is substantially identical in design and operation to pallet container 100 described above with reference to FIGS. 1, 2, 3, 4, 5, 6, 7*a*, 7*b*, 8, 9*a*, 9*b*, 10, 11, and 12 with the addition of a modified single piece of material including a plurality of base portions 902*a*, 902*b*, 902*c*, and 902*d*. Base portion 902*a* is perforated along lines 902*aa*, 902*ab*, 902*ac*, and 902*ad*, all which run parallel to each other. A plurality of tabs 902*ae* and 902*af* are positioned on opposite sides of base portion 902*a*. Base portion 902*b* is positioned adjacent to base portion 902*a* and is perforated along lines 902*ba* and 902*bb*, which run parallel to each other. Base portion 902*c* is positioned adjacent base portion 902*b* and is perforated along lines 902*ca*, 902*cb*, 902*cc*, and 902*cd*, all which run parallel to each other. A plurality of tabs 902*ce* and 902*cf* are positioned on opposite sides of base portion 902*c*. Base portion 902*d* is positioned adjacent to base portion 902*c* and is perforated along lines 902*da* and 902*db*, which run parallel to each other.

A plurality of side walls 904*a*, 904*b*, 904*c*, and 904*d* extend from, and are bendably coupled to, the base portions 902*a*, 902*b*, 902*c*, and 902*d*, respectively. Side wall 904*a* defines a plurality of channel inlets/outlets 904*aa* and 904*ab* on its edge. Side wall 904*b* extends between, and is bendably coupled to, side walls 904*a* and 904*c*. Side wall 904*c* defines a plurality of channel inlets/outlets 904*ca* and 904*cb* on its edge. Side wall 904*d* extends from, and is bendably coupled to, side wall 904*c*. A tab 904*da* extends from side wall 904*d*.

A plurality of top portions 906*a*, 906*b*, 906*c*, and 906*d* extend from side walls 904*a*, 904*b*, 904*c*, and 904*d*, respectively. Top portion 906*a* is bendably coupled to side wall 904*a*. Top portion 906*b* is bendably coupled to side wall 904*b*. Top portion 906*c* is bendably coupled to side wall 904*c*. Top portion 906*d* is bendably coupled to side wall 904*d*.

Figure 14:
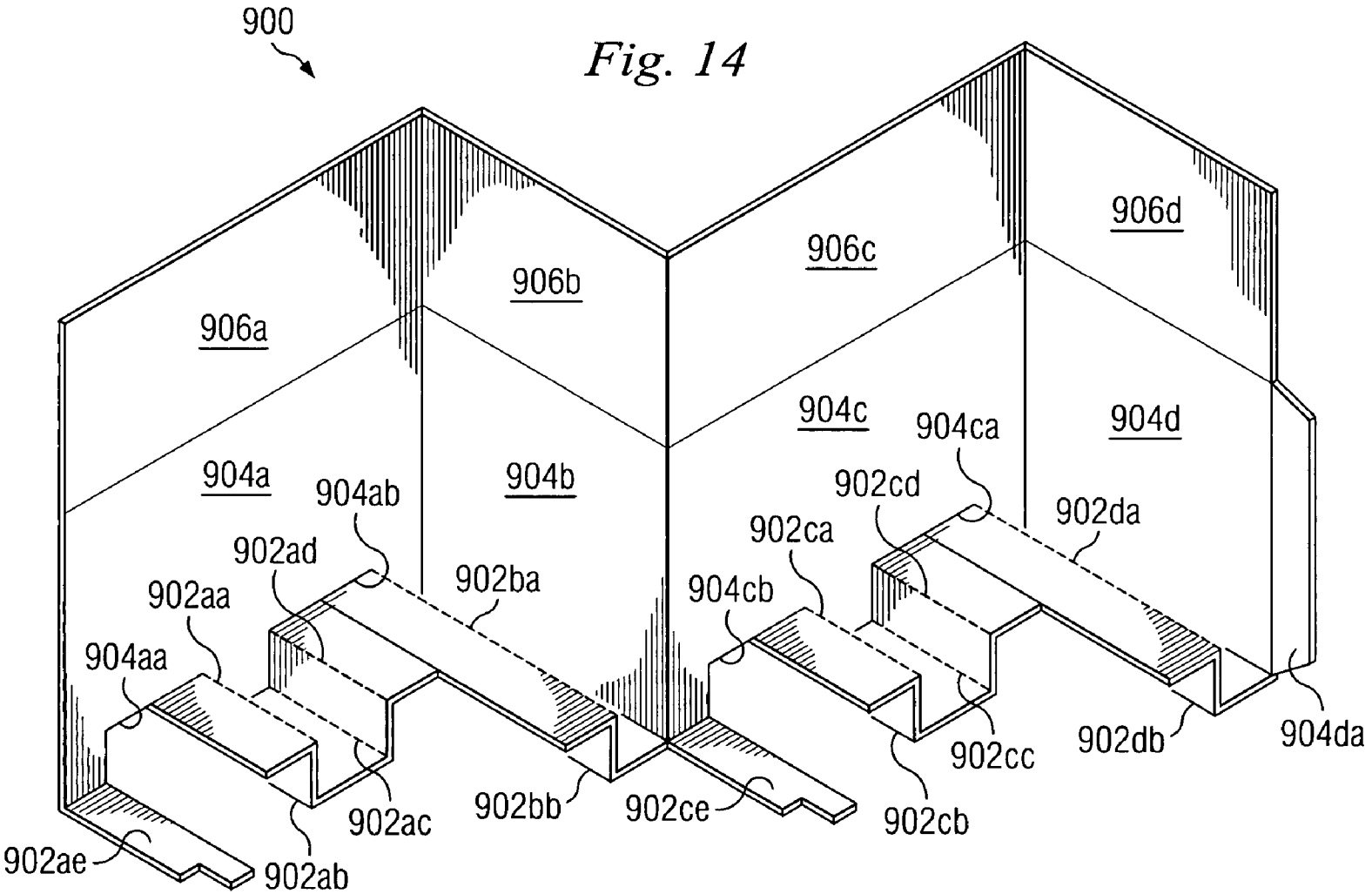
FIG. 14 is a perspective view illustrating an exemplary embodiment of the pallet container of FIG. 13 partially assembled.

Referring now to FIGS. 13 and 14, in assembly operation, pallet container 900 begins assembly by bending base portion 902*a* with respect to side wall 904*a* until the two are at approximately a ninety degree angle. Base portion 902*a* then be bent at approximately ninety degree angles along lines 902*aa*, 902*ab*, 902*ac* and 902*ad* such that an edge of base portion 902*a* runs along portions of channel inlets/outlets 904*aa* and 904*ab*. Tabs 902*ae* and 902*af* may be bent at approximately ninety degree angles with respect to side wall 904*a*. Side wall 904*b* may then be bent with respect to side wall 904*a* until the two are at approximately a ninety degree angle. Base portion 902*b* may then be bent at approximately ninety degree angles along lines 902*ba* and 902*bb* such that an edge of base portion 902*b*runs along a portion of channel inlet/outlet 904*ba*, with tab 902*af* positioned between side wall 904*b* and line 902*bb*.

Base portion 902*c* is then bent with respect to side wall 904*c* until the two are at approximately a ninety degree angle. Base portion 902*c* then be bent at approximately ninety degree angles along lines 902*ca*, 902*cb*, 902*cc* and 902*cd* such that an edge of base portion 902*c* runs along portions of channel inlets/outlets 904*ca* and 904*cb*. Tabs 902*ce* and 902*cf* may be bent at approximately ninety degree angles with respect to side wall 904*a*. Side wall 904*d* may then be bent with respect to side wall 904*c* until the two are at approximately a ninety degree angle. Base portion 902*d* may then be bent at approximately ninety degree angles along lines 902*da* and 902*db* such that an edge of base portion 902*d* runs along a portion of channel inlet/outlet 904*ca*, with tab 902*cf* positioned between side wall 904*d* and line 902*db*.

Side wall 904*c* is then bent with respect to side wall 904*b* until the two are at approximately a ninety degree angle. Tab 902*ce* may then be positioned between side wall 904*b* and line 902*bb* with an edge of base portion 902*b* running along a portion of channel inlet/outlet 904*cb*, and tab 902*ae* may be positioned between side wall 904*d* and line 902*db* with an edge of base portion 902*d* running along a portion of channel inlet/outlet 904*aa*. In an exemplary embodiment, tab 904*da* may be secured to side wall 904*a* using glue, staples, or other conventional securing means known in the art. In an exemplary embodiment, tab 904*ae* may be secured to tab 902*cf* using glue, staples, or other conventional securing means known in the art. In an exemplary embodiment, tab 904*af* may be secured to tab 904*ce* using glue, staples, or other conventional securing means known in the art. In an exemplary embodiment, base portion 902*a* may be secured to base portion 902*b* using glue, staples, or other conventional securing means known in the art. In an exemplary embodiment, base portion 902*a* may be secured to base portion 902*c* using glue, staples, or other conventional securing means known in the art. In an exemplary embodiment, base portion 902*a* may be secured to base portion 902*d* using glue, staples, or other conventional securing means known in the art. In an exemplary embodiment, base portion 902*c* may be secured to base portion 902*b* using glue, staples, or other conventional securing means known in the art. In an exemplary embodiment, base portion 902*c* may be secured to base portion 902*d* using glue, staples, or other conventional securing means known in the art. Further assembly of pallet container 900 is substantially similar to the assembly of pallet container 100 as illustrated above with reference to FIGS. 8, 9*a*, 9*b*, 10, 11, and 12.

It is understood that variations may be made in the foregoing without departing from the scope of the invention. Furthermore, the elements and teachings of the various illustrative embodiments may be combined in whole or in part some or all of the illustrative embodiments.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A corrugate palletized container comprising:

a foldable single piece of material comprising plural side wall panels, plural top panels and plural bottom panels, the bottom panels forming a plurality of channels between a plurality of reinforcing portions, the material being folded to form a container;

a separate reinforcing member in each of the reinforcing portions;

a separate reinforcing insert in each channel;

a separate first reinforcing panel adjacent the channels and the reinforcing portions;

a separate second reinforcing panel adjacent the first reinforcing panel, the second reinforcing panel having a plurality of arms inserted between opposite ones of the side walls and the reinforcing members; and at least one separate exterior base reinforcing member.

2. The container of claim 1 wherein each reinforcing member includes a honeycomb cross-section.

3. The container of claim 1 wherein each reinforcing member includes a pair of base members coupled together by a honeycomb member.

4. The container of claim 1 wherein the plurality of channels comprise a pair of parallel channels, the pair of parallel channel operable to receive a forked lifting device therein.

5. A method for palletizing a product comprising:

providing a foldable single piece of corrugate material comprising plural side wall panels, plural top panels and plural bottom panels, the bottom panels forming a plurality of channels between a plurality of reinforcing portions, the material being folded to form a palletized container;

inserting a separate reinforcing member in each of the reinforcing portions;

placing a separate reinforcing insert in each channel;

placing a separate first reinforcing panel adjacent the channels and the reinforcing portions;

placing a separate second reinforcing panel adjacent the first reinforcing panel, the second reinforcing panel having a plurality of arms inserted between opposite ones of the side walls and the reinforcing members; and attaching at least one separate exterior base reinforcing member.

6. The method of claim 5, further comprising:

placing a product in the container.

7. The method of claim 6, further comprising:

folding the top panels to enclose the product in the container.

8. The method of claim 5, further comprising:

providing each reinforcing member with a pair of base members coupled together by a honeycomb member.

* * * * *